US006095598A

United States Patent [19]

Piretti

[11] Patent Number: 6,095,598

[45] Date of Patent: Aug. 1, 2000

[54] CHAIR ARM-REST HAVING A PIVOTABLE FRONT PORTION, AND A CHAIR INCLUDING THIS ARM-REST

[75] Inventor: Giancarlo Piretti, Bologna, Italy

[73] Assignee: Desital Holland B.V., Amsterdam, Netherlands

[21] Appl. No.: 09/305,210

[22] Filed: May 5, 1999

[30] Foreign Application Priority Data

Jun. 5, 1998 [EP] European Pat. Off. ..... 98110293

[51] Int. Cl.[7] ..... A47C 17/04

[52] U.S. Cl. ..... 297/115; 297/162; 297/411.35

[58] Field of Search ..... 297/115, 160, 297/161, 162, 188.14, 411.35, 411.2, 411.37, 411.34

[56] References Cited

U.S. PATENT DOCUMENTS

| | | | |
|---|---|---|---|
| 3,368,842 | 2/1968 | Polsky | 297/411.34 X |
| 5,087,096 | 2/1992 | Yamazaki | 297/162 X |
| 5,290,092 | 3/1994 | Geer | 297/115 X |
| 5,292,173 | 3/1994 | Lambert | 297/188.14 X |
| 5,853,223 | 12/1998 | Ritt et al. | 297/411.35 X |

FOREIGN PATENT DOCUMENTS

| | | |
|---|---|---|
| 0 727 162 | 8/1996 | European Pat. Off. . |
| 0727162A2 | 8/1996 | European Pat. Off. . |

*Primary Examiner*—Peter M. Cuomo
*Assistant Examiner*—Stephen Vu
*Attorney, Agent, or Firm*—Sughrue, Mion, Zinn, Macpeak & Seas, PLLC

[57] ABSTRACT

A chair arm-rest comprises a rear portion secured to the supporting structure of the arm-rest, and a front portion which is pivotally mounted to the rear portion around an axis substantially parallel to the longitudinal direction of the arm-rest and adapted to assume two different operative positions which are spaced from each other by about 180°. The articulation axis is offset towards one side of the rear portion of the arm-rest, so that in one of said two operative positions the front portion projects towards the inner side of the arm-rest with respect to the rear portion, so as to provide adequate support for the arm of the occupant when the latter must perform an operation at the keyboard of a typewriter or a computer.

5 Claims, 4 Drawing Sheets

CHAIR ARM-REST HAVING A PIVOTABLE FRONT PORTION, AND A CHAIR INCLUDING THIS ARM-REST

BACKGROUND OF THE INVENTION

The present invention relates to chair arm-rests, particularly for office chairs, of the type comprising a supporting structure, which is to be connected to the chair structure, and an arm-rest body mounted on the supporting structure.

SUMMARY OF THE INVENTION

The object of the present invention is that of providing an arm-rest which ensures an adequate support for the arm of the chair occupant, either in a rest condition, or when the user has to work at the keyboard of a computer or a typewriting machine.

A further object of the invention lies in the provision of an arm-rest of the above indicated type which has a relatively simple and inexpensive structure, which is also convenient and efficient in use.

In view of achieving these and further objects, the invention provides a chair arm-rest of the above indicated type, characterized in that said arm-rest body comprises a rear portion connected to the supporting structure, and a front portion which is pivotally mounted on the rear portion around an axis substantially parallel to the longitudinal direction of the arm-rest, said front portion being rotatable between two operative positions which are angularly spaced from each other by about 180°, said articulation axis being offset towards one side of the rear portion of the arm-rest, so that in one of the two above mentioned operative positions the front portion projects towards the inner side of the arm-rest with respect to the rear portion.

Due to the above indicated features, the arm-rest is able to assume two different configurations, respectively adapted to support the arm of the chair occupant in a rest position and in a position for working at the keyboard.

Naturally, the invention also provides a chair comprising at least one arm-rest of the above indicated type. Obviously, in the preferred embodiment, the chair according to the invention comprises two arm-rests of the above indicated type. The user is able of rotating the front portions of the two arm-rests easily so as to move them between the operative position of normal use, adapted for supporting the arm in a rest condition, and the operative position adapted for working at the keyboard, in which the front portions of the two arm-rests both project inwardly with respect to the respective rear portions of the arm-rests.

BRIEF DESCRIPTION OF THE DRAWINGS

Further features and advantages of the invention will become apparent from the description which follows with reference to the annexed drawings, given purely by way of non limiting example, in which.

DETAILED DESCRIPTION OF THE DRAWINGS

Figure 2:
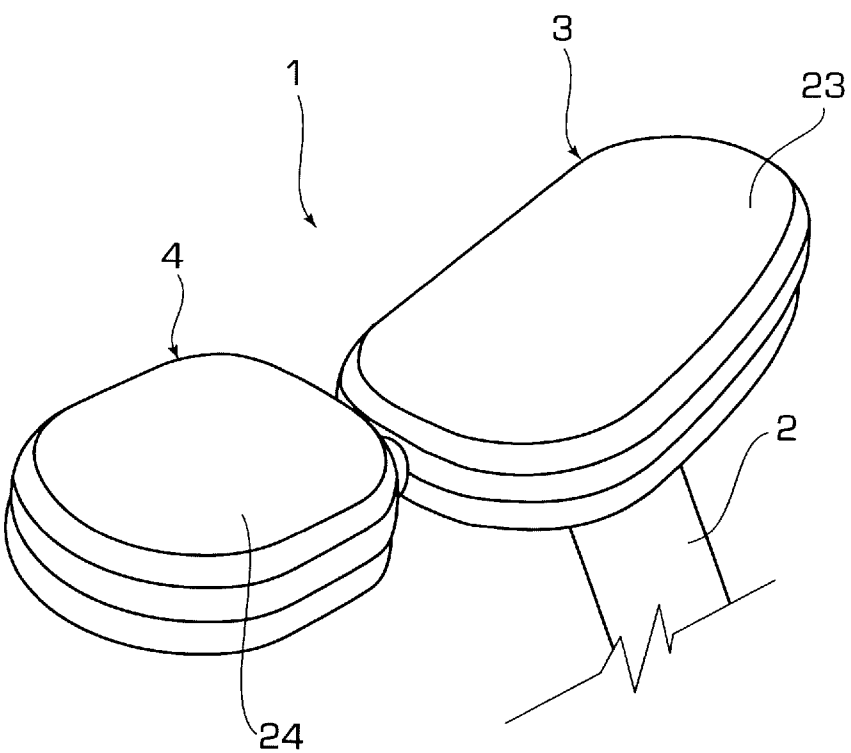
FIG. 2 is a perspective view of the arm-rest of FIG. 1 in a second operative position.

In the drawings, reference numeral 1 generally designates a lefthand arm-rest for an office chair. In the drawings, the structure of the chair is not shown, since it can be made in any known way. This structure obviously comprises a base structure carrying a seat and a backrest. To the base structure there are connected two side vertical uprights which carry the respective arm-rests. In the drawings, reference numeral 2 designates the upper end of the lefthand upright of the chair. This end is anchored in any known way, e.g. by screws, to the rear portion 3 of arm-rest 1. The arm-rest 1 has a body constituted by a rear portion 3 and a front portion 4 which is pivotally mounted onto the rear portion 3 around an axis 5 substantially parallel to the longitudinal direction of the arm-rest.

Figure 7:
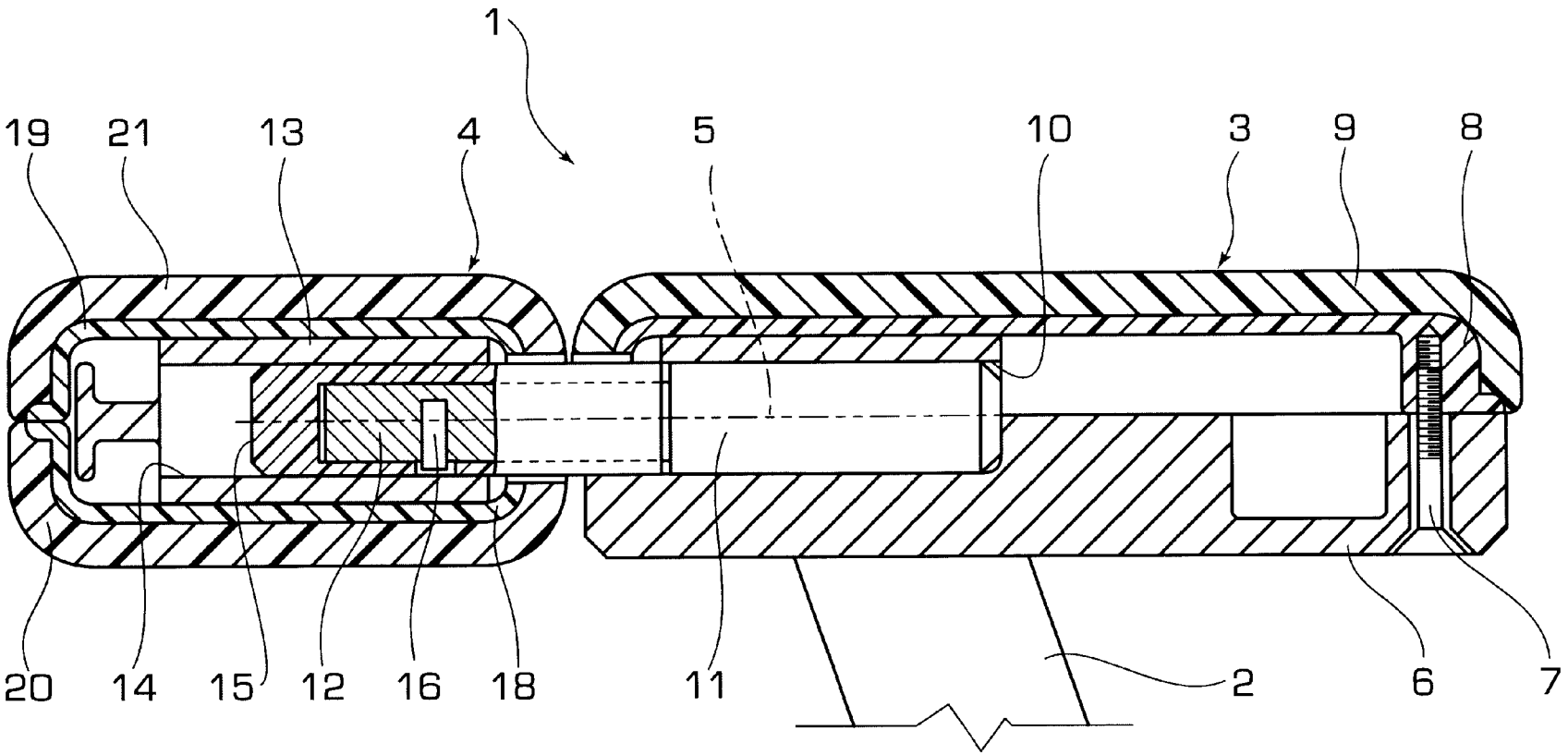
FIG. 7 is a cross-sectional view taken along line VII—VII of FIG. 3.

In the illustrated embodiment, the rear portion 3 comprises a metal lower body 6, e.g. of aluminium, on which there is secured by screws 7 (only one of which is visible in FIG. 7) an upper body 8 of plastic material covered by a layer 9 also of plastic material. The lower body 6 of the rear portion 3 of the arm-rest defines a cylindrical seat 10 within which there is fitted an end portion 11 of an articulation pin 12, projecting forwardly from the rear portion 3.

In the illustrated embodiment, the front portion 4 comprises an inner structure of aluminium 13 having a cylindrical seat 14 in which there is secured a bush of plastic material 15 where the pin 12 is rotatably mounted. The pin 12 has a transverse pin 16 having one end projecting therefrom and engaging a circumferential slot 17 formed in bush 15. The slot 17 extends substantially through an angle of 180°, so that its end surfaces acts as stop surfaces for the projecting end of pin 16 so as to define stop means for defining the two operative positions of the front portion 4 of arm-rest 1.

In the illustrated embodiment, the body 13 of aluminium of the front portion 4 is covered by two upper and lower half-shells 18, 19 of plastic material, which on their turn are provided with coatings 20, 21 of plastic material.

As shown in FIGS. 1–4, in the illustrated embodiment, the two arm-rest portions 3, 4 have a substantially flattened shape with upper surfaces 22, 23 planar and coplanar and two opposite surfaces which are also planar and coplanar. In FIG. 2, by 24 there is designated the face of front portion 4 of the arm-rest opposite to the upper surface 22.

As clearly apparent from the drawings, the axis 5 is offset towards the inner side of the arm-rest, with respect to a theoretical median line of the arm-rest. Therefore, the front portion 4 is able to assume both a first operative condition (FIG. 3) in which it is arranged substantially on the extension of the rear portion 33, and a second operative position, in which the front portion 4 is offset laterally inwardly with respect to the rear portion 3. Naturally, in the present description and in the appended claims, by "inner side" of the arm-rest the side of the arm-rest is meant which faces towards the inside of the chair, i.e. the side shown on the left in FIGS. 1, 2 or on the right in FIGS. 3, 4 (which are bottom views).

Figure 1:
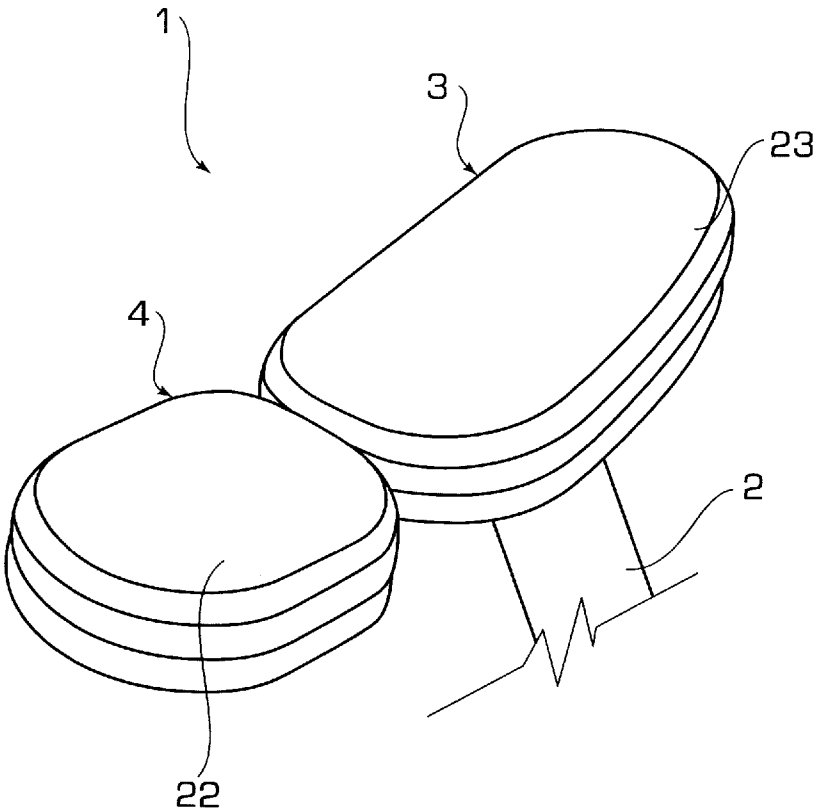
FIG. 1 is a perspective view of an arm-rest according to the invention in a first operative position.
Figure 3:
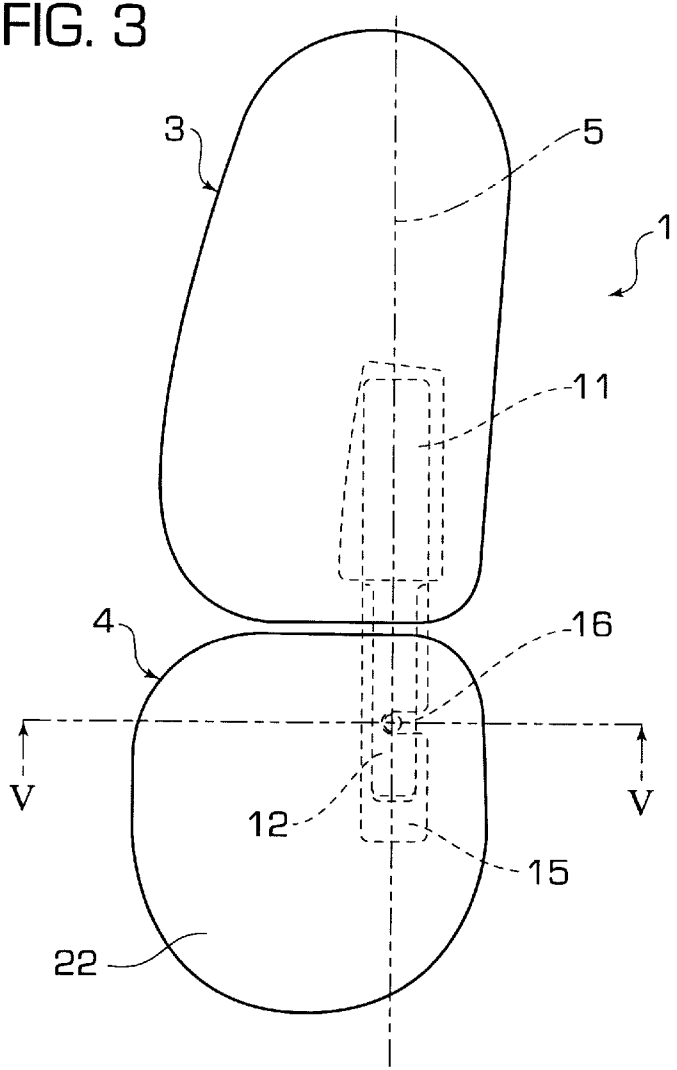
FIGS. 3, 4 are views from the bottom of the arm-rest respectively in the positions of FIGS. 1, 2, FIGS. 5, 6 are cross-sectional views taken along lines V—V of FIG. 3 and VI—VI of FIG. 4, respectively.
Figure 4:
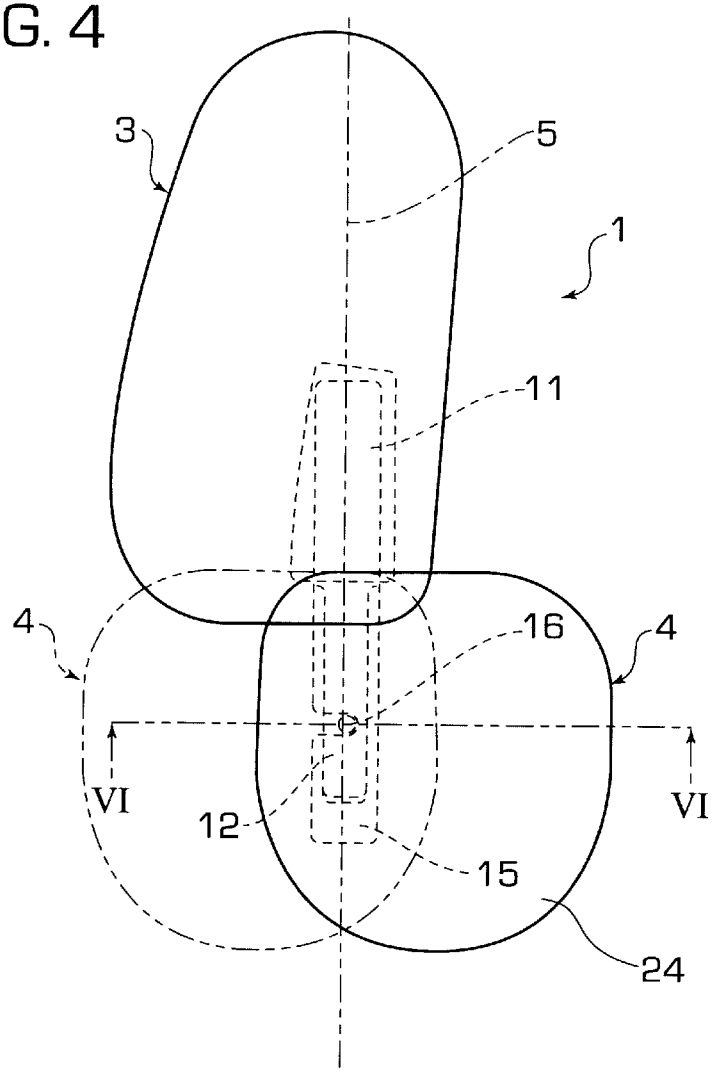
Figure 6:
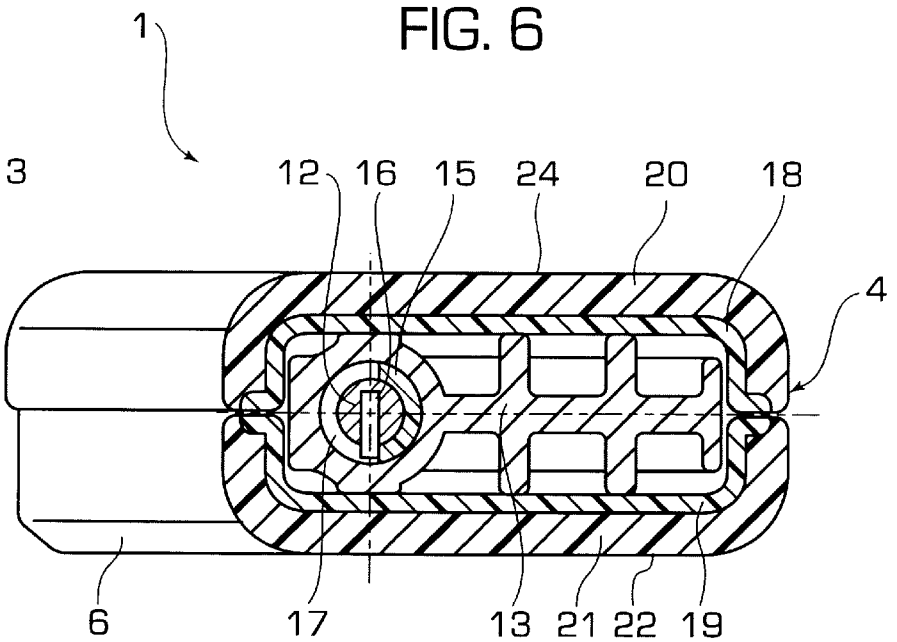
Figure 5:
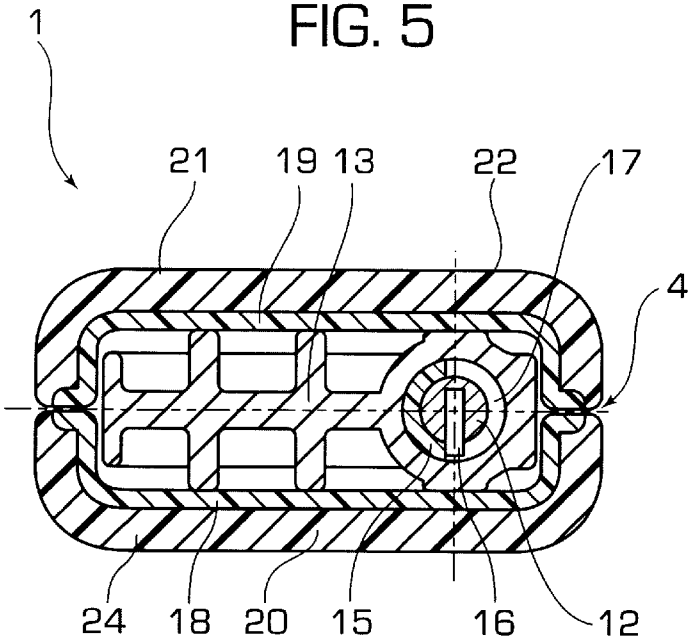

The first operative condition shown in FIGS. 1, 3 is adapted to provide adequate support to the arms of the occupant when the latter is in a normal rest condition or working at the desk. When instead it is necessary to perform an operation at a keyboard, the user preferably moves the front portions 4 of the arm-rests associated to the chair to the operative condition shown in FIGS. 2, 4. In this manner, the ends of the arms adjacent to the keyboard receive adequate support.

As it will be clearly apparent from the foregoing description, the arm-rest according to the invention is characterized by an extreme simplicity of construction and hence by a low cost, as well as by a great conveniency and simplicity of use.

Naturally, while the principle of the invention remains the same, the details of construction and the embodiments may widely vary with respect to what has been described and shown purely by way of example, without departing from the scope of the present invention. In particular, the materials can be different from those indicated. For example, also structures 6, 13 can be made of plastics.

In the foregoing description, for sake of simplicity, the means for securing the two half-shells 18, 19 to the front portion 4 of the arm-rest has not been shown. Typically, these elements are secured to the inner structure 13 of aluminium by screws. However, any other type of connection is naturally possible.

What is claimed is:

1. An arm-rest for a chair comprising a rear arm-rest portion adapted to be fixedly mounted on a support structure of the chair, and articulation pin mounted in said rear arm-rest portion substantially parallel to a longitudinal axis of said rear arm-rest portion and having a projecting portion projecting forwardly from said rear arm-rest portion, a front arm rest portion rotatably mounted on said projecting portion of said articulation pin for rotation between first and second operative positions angularly spaced from each other by about 180°, said front arm-rest portion and said rear arm-rest portion each having upwardly facing supports surfaces with the support surface of the rear arm-rest portion being substantially larger than the support surface of said front arm-rest portion.

2. The arm-rest as set forth in claim 1, wherein said articulation pin is offset toward one side of said front and rear arm-rest portions so that upon rotation of said front arm-rest portion to said first operative position, said first and second arm-rest portions will be in substantial longitudinal alignment and upon rotation of said front arm-rest portion to said second operative position, said front arm-rest portion will be substantially offset laterally relative to said rear arm-rest portion.

3. The arm-rest as set forth in claim 2, wherein said stop means are constituted by a transverse pin having one end projecting radially from said articulation pin which is received within a circumferential slot formed in said bush, said slot having end surfaces acting as stop surfaces for said projecting transverse pin.

4. The arm-rest as set forth in claim 1, wherein said front arm rest portion is provided with a bush rotatably mounted on said projecting portion of said articulation pin, said pin and said bush being provided with stop means cooperating with each other for defining the first and second operative positions of the front arm rest portion.

5. A chair comprising at least one arm rest portion according to claim 1.

* * * * *